US005676035A

United States Patent [19]

Chrestoff et al.

[11] Patent Number: 5,676,035

[45] Date of Patent: Oct. 14, 1997

[54] CAM FOLLOWER RETAINER FOR A SWASHPLATE PUMP

[75] Inventors: Brian Michael Chrestoff, Magnolia; Robert Henry Ash, Jr., Humble, both of Tex.

[73] Assignee: FMC Corporation, Chicago, Ill.

[21] Appl. No.: 611,315

[22] Filed: Mar. 5, 1996

[51] Int. Cl.[6] ..... F01B 3/00

[52] U.S. Cl. ..... 92/71; 91/499; 417/269; 74/60; 384/121; 384/909

[58] Field of Search ..... 92/122, 71, 57; 417/269; 91/499; 74/60; 384/121, 420, 909

[56] References Cited

U.S. PATENT DOCUMENTS

| | | | |
|---|---|---|---|
| 3,190,231 | 6/1965 | Thoma | 384/303 |
| 3,221,564 | 12/1965 | Raymond | 417/269 |
| 3,565,498 | 2/1971 | Leopard et al. | 384/303 |
| 4,728,201 | 3/1988 | Abbe | 384/121 |
| 4,741,251 | 5/1988 | Hayashi et al. | 92/57 |
| 4,893,548 | 1/1990 | Kawahara et al. | 91/499 |
| 5,013,219 | 5/1991 | Hicks et al. | 417/269 |
| 5,046,403 | 9/1991 | Riedhammer | 74/60 |
| 5,228,379 | 7/1993 | Kawai et al. | 92/71 |

OTHER PUBLICATIONS

FMC'S Series C Composite Piston Pumps brochure; 1994.

*Encyclopedia of Plastics* p. 28 dated Dec. 1989.

*Primary Examiner*—Thomas E. Denion

[57] ABSTRACT

In a swashplate style pump a cam follower that interfaces the pump pistons and the swashplate cam is a ring of material. This ring of material will be provided with a bearing surface and a piston contacting surface having the piston contacting surface provided with piston receiving elements.

10 Claims, 2 Drawing Sheets

CAM FOLLOWER RETAINER FOR A SWASHPLATE PUMP

BACKGROUND OF THE INVENTION

1. Field of the Invention

This invention has to do with swashplate pumps and specifically with a cam follower interfaced between the pistons of the pump and the inclined swashplate drive cam. The cam follower is a single piece of non-metallic material replacing multi-part cam followers in the prior art.

2. Description of the Prior Art

Swashplate pumps have been in use in the fluid pumping field for many years. They are typically used in pumping fluids wherein a non-pulsed output stream is desired. This style of pump is efficient and does not have the pumping losses sometimes inherent in pumps of other designs. The closest prior art to the invention presented herein is the "Delpump" formerly manufactured by CHPT Incorporated as disclosed further on in this specification.

SUMMARY OF THE INVENTION

As stated above the invention resides in an improvement to swashplate pumps and specifically those swashplate pumps with a cam follower interfaced between the pistons of the pump and the inclined swashplate drive cam. The cam follower used in the invention is a single piece of non-metallic material replacing multi-part cam followers in the prior art. The cam follower includes a surface that will receive the arcuate ends of the pistons of the pump and the obverse surface will include bearing surfaces that transmit the load from the inclined cam surface of the swashplate to the pump pistons.

One advantage of this invention over the prior art is that the improvement presented here will significantly out perform, in at least the life of the part and the pump, the style of cam follower retainer used in prior art devices. It has been determined that the a cause of pump failure in some pumps would initiate with the multi-part cam follower designs which had difficulty coping with the harmonic forces leading to rapid cyclical fatigue of the cam follower retainer. The fact that the cluster bearing presented herein is made of a material that includes carbon is a further assurance that even if there is a failure in maintaining a hydrodynamic film of lubrication between the cluster bearing and the cam surface the necessary lubrication will be provided.

It has been further determined that pump failure, or at least a denigration of pump capacity, could be caused by the direct fatiguing of the cam follower pads through high cycle impacts against the cam surface. "Bouncing" of the cam follower pads, the motion that contributed to failures of cam follower pads of the prior art, is not seen as a problem with the design presented herein.

BRIEF DESCRIPTION OF THE DRAWINGS

The invention is graphically presented by several drawing figures including the following figures.

DESCRIPTION OF THE PREFERRED EMBODIMENT

Swashplate pumps of the type incorporating the improvement invention set forth herein are well known in the industry. The specific pump to which this improvement applies is FMC Corporation's "Series C Composite Piston Pumps" previously manufactured under the trademark Delpump by CHPT Incorporated. U.S. Pat. No. 5,013,219 applies to this pump. The pump is described in literature available from FMC in Houston, Tex.

Figure 1:
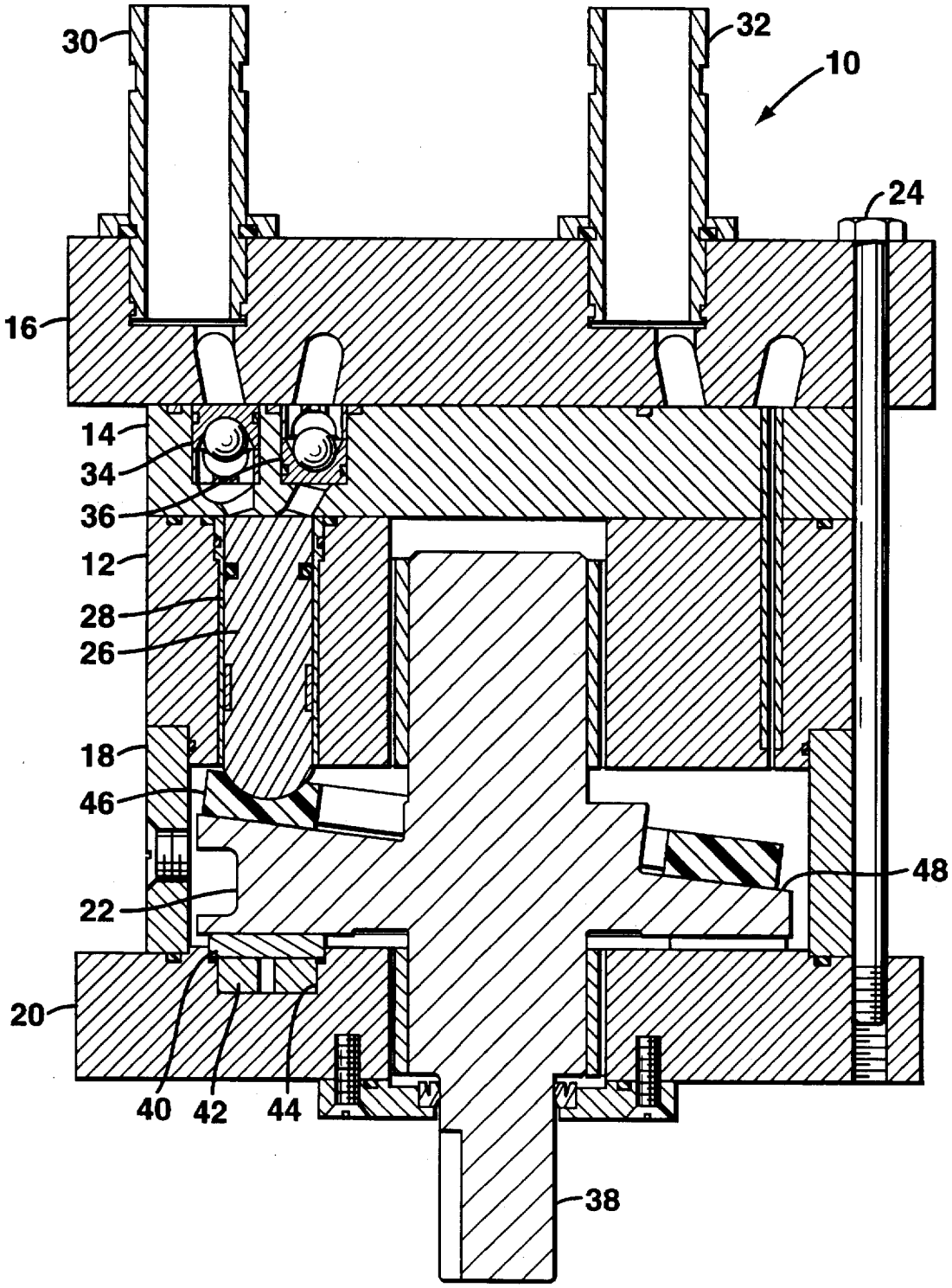
FIG. 1 is a cross sectional view of a swashplate pump incorporating the invention.

Looking at FIG. 1, a sectional view of a swashplate pump, generally 10, is shown. A body 12 is capped with a check valve housing 14 which in turn is capped with a gallery 16. A cam spacer 18 supports the body 12 away from back plate 20 providing a cavity for the cam subassembly 22. Hex nuts such as 24 will clamp the gallery 16, check valve housing 14, body 12, cam spacers 18 and the back plate together as shown in FIG. 1.

A piston 26, one of several, generally between five and twelve in number depending on pump capacity, which in used in a pump of this type is carried in a lined cylinder 28 in the body 12. This piston 26 will be urged to travel reciprocally in the lined cylinder 28 by the well known principal of the camming action of the swashplate design pump. Fluid to be pumped will enter the pump 10 through inlet fitting 30 and be pumped out of the outlet fitting 32. Check valves such as 34 and 36, one set of check valves associated with one each of said pistons 26, will control flow of the pumped fluid into and out of the pump.

The cam 22 includes an extended portion 38 which is the mechanical drive input shaft for rotating the integral cam 22 and shaft assembly.

Cam thrust bearings, such as 40, supported on mounting pads 42 in cavities 44 in the back plate 20 are shown. There may be numerous cam thrust bearings 40 used to provide a bearing surface between the bottom non-angled surface of the cam 22 and the back plate.

Figure 2:
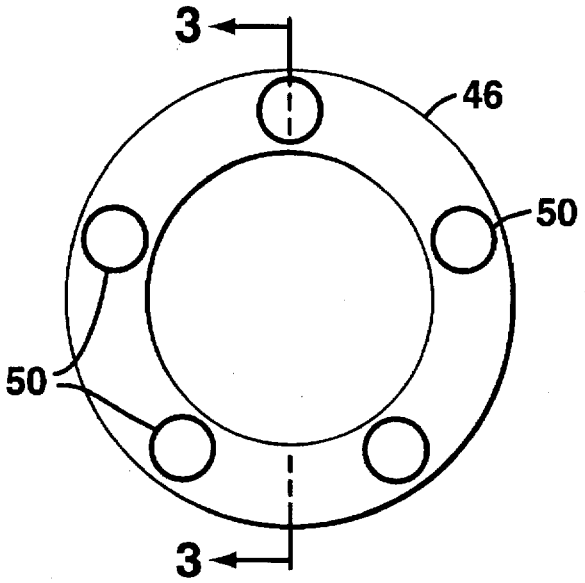
FIG. 2 is a top view of the cam follower cluster bearing.
Figure 3:
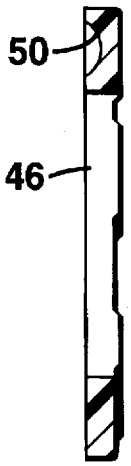
FIG. 3 is a view of the cam follower cluster bearing taken through 3—3 of FIG. 2.

The invention presented herein is the cluster bearing 46. This cluster bearing 46 resides between the piston 26, actually the arcuate end portion of the piston, and the flat cam surface 48 of the cam 22. The cluster bearing 46, shown in the sectional view of FIG. 1 is shown removed from the pump in FIGS. 2, 3, and 4.

In these figures the cluster bearing is shown with the piston receiving bearing cups, such as 50, which are concave receivers which accommodate the arcuate ends of the pistons 26. Five piston receiving bearing cups 50 are shown in the cluster bearing 46 of FIG. 2; however, this number is dependent on pistons and the pump and would normally be between five and twelve in today's production pumps. The bearing cups 50 are formed integrally into a web of material and the piston cups, indentations in the web, are axially spaced around the web.

Figure 4:
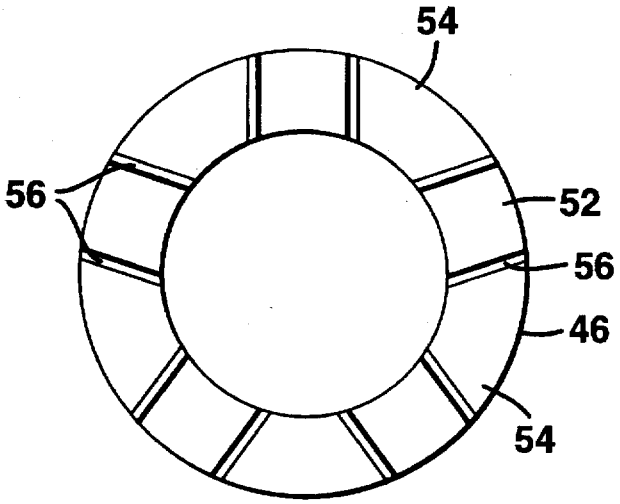
FIG. 4 is the obverse side of the cam follower cluster bearing shown in FIG. 2.

The obverse side (from FIG. 2) of the cluster bearing 46 is shown in FIG. 4. In this figure items such as 52, there are five shown, are thrust bearing surfaces which are generally "under" and aligned with the piston receiving bearing cups 50. They will provide thrust bearing surfaces that ride proximate to the flat cam surface 48 of the cam 22. These thrust bearing pads or surfaces 52 will absorb the discharge and suction pressure load on the pistons. They will ride on the inclined surface of the rotating cam and will be lubricated with a naturally forming hydrodynamic film of water or other liquid to separate the surface of the cluster bearing from the surface of the rotating cam. The preferred material for the single piece injection molded cluster ring is Arlon 1555 PEEK. If the lubrication between contact surfaces of the cluster bearing and cam experience a drop in viscosity or transient load conditions that create contact between the cluster bearing 46 and the cam surface 48, the carbon filled PEEK cluster bearing will provide lubrication.

On the obverse side of the cluster bearing the areas between the thrust bearing surface pads 52, the relief zones such as 54, are relatively lower than the thrust bearing surfaces 52. A slight ramp, such as 56 is formed to transition between the relief zones 54 and the thrust bearing surface pads 52 on both sides of the pads.

Figure 5:
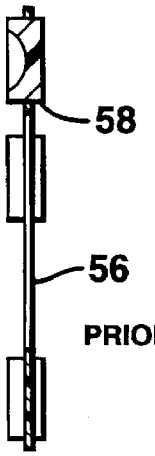
PRIOR ART FIG 5
FIG. 5 is a cam follower retainer and cam followers of the prior art.

FIG. 5 shows a prior art cam follower ring 56 with cam followers 58. In this device the cam follower ring 56 is a relatively thin circular element provided with holes to accommodate the independent cam followers 58. The cam followers are placed in the holes in the cam follower ring 56 but are not formed integrally therewith. In a prior art device the material of the cam followers and the cam follower ring were of different materials. The bottom of the prior art cam followers 58 would ride on the cam surface 48 of the pump. As stated above, the structural integrity of this prior art construction has been improved by the device presented herein, namely the cluster bearing 46.

It is believed that the foregoing explanation and description, when read in juxtaposition with a review of the drawing figures, of the invention provides a full teaching of the invention. The inventors recognize that design changing the cluster bearing are possible, such as the use of different material having similar properties to the preferred material herein. It is expected that the following claims will cover such nuances of design and product selection.

What is claimed is:

1. A cluster bearing for use in a swashplate pump, said cluster bearing comprising a continuous ring of material having a generally flat first surface and a generally flat second surface opposite the first surface, a plurality of piston receiving bearing cups formed integrally into the first surface and a plurality of thrust bearing pads extending integrally from the second surface.

2. The invention in accordance with claim 1 wherein said thrust bearing pads extend opposite and in alignment with said piston receiving bearing cups.

3. The invention in accordance with claim 2 wherein a ramp surface exists between each of said thrust bearing pads and an adjacent portion of the second surface.

4. The invention in accordance with claim 3 wherein said cluster bearing is a non-metallic material including carbon in the composition of the material.

5. The invention in accordance with claim 4 wherein said material is an injection molded PEEK construction.

6. The invention in accordance with claim 5 wherein said material is Arlon 1555 PEEK.

7. A swashplate pump including a body, said body containing a cam having an inclined surface, and multiple pistons carried inside said body, said pistons having arcuate surfaces at one end thereof, the improvement comprising:

a cluster bearing positioned inside said body between said arcuate surfaces of said pistons and said inclined surface of said cam, said cluster bearing comprising a continuous ring of material having a generally flat first surface and a generally flat second surface opposite the first surface, a plurality of piston receiving bearing cups formed integrally into the first surface for receiving said pistons, and a plurality of thrust bearing pads extending integrally from the second surface.

8. The invention in accordance with claim 7 wherein said thrust bearing pads extend opposite and in alignment with said piston receiving bearing cups.

9. The invention in accordance with claim 8 wherein a ramp surface exists between each of said thrust bearing pads and an adjacent portion of the second surface.

10. The invention in accordance with claim 9 wherein said cluster bearing is a non-metallic material including carbon in the composition of the material.

* * * * *